US008790231B2

(12) United States Patent
Lamkemeyer et al.

(10) Patent No.: US 8,790,231 B2
(45) Date of Patent: Jul. 29, 2014

(54) DEVICE AND METHOD FOR THE PRODUCTION OF TUBES OR SECTIONS OF TUBES

(75) Inventors: Andreas Lamkemeyer, Georgsmarienhuette (DE); Achim Seeberger, Lengerich (DE)

(73) Assignee: Windmoeller & Hoelscher KG, Lengerich (DE)

( * ) Notice: Subject to any disclaimer, the term of this patent is extended or adjusted under 35 U.S.C. 154(b) by 265 days.

(21) Appl. No.: 13/151,650

(22) Filed: Jun. 2, 2011

(65) Prior Publication Data

US 2011/0301007 A1 Dec. 8, 2011

(30) Foreign Application Priority Data

Jun. 2, 2010 (DE) ..... 10 2010 029 674

(51) Int. Cl.
*B31C 11/04* (2006.01)

(52) U.S. Cl.
USPC ..... 493/276; 493/186; 493/254; 493/285

(58) Field of Classification Search
USPC ..... 493/186, 254, 264, 269, 276, 285, 286
See application file for complete search history.

(56) References Cited

U.S. PATENT DOCUMENTS

| | | | | |
|---|---|---|---|---|
| 5,802,945 | A | 9/1998 | Brinkmeier et al. | |
| 7,731,647 | B2 * | 6/2010 | Duwendag et al. | 493/218 |
| 8,016,734 | B2 * | 9/2011 | Fort | 493/264 |
| 2003/0230634 | A1 * | 12/2003 | Heide et al. | 239/10 |
| 2005/0087293 | A1 * | 4/2005 | Colgan | 156/291 |
| 2006/0189468 | A1 * | 8/2006 | DeMatteis et al. | 493/276 |

FOREIGN PATENT DOCUMENTS

| | | |
|---|---|---|
| DE | 195 44 330 | 6/1997 |
| DE | 10 2007 032 401 | 1/2009 |

* cited by examiner

*Primary Examiner* — Hemant M Desai
(74) *Attorney, Agent, or Firm* — Jacobson Holman, PLLC.

(57) ABSTRACT

A device for the production of tubes or sections of tubes having at least one paper layer, from which paper bags can be manufactured, includes an unwinder device for unrolling at least one material web from a material web roll, a device for the provision of at least one edge region of each material web with glue, and a tube forming device via which the edge region provided with glue can be inverted onto, and attached to, a second edge region. The tubes or sections of tube can be provided with air-permeable channels in the device. The device for providing at least one edge area of each material web with glue has glue application valves, with at least two glue application valves being functionally assigned to each material web, and with noncontinuous glue tracks being produced with the glue application valves such that interruptions therein form the air-permeable channels.

14 Claims, 4 Drawing Sheets

DEVICE AND METHOD FOR THE PRODUCTION OF TUBES OR SECTIONS OF TUBES

CROSS-REFERENCE TO RELATED APPLICATIONS

This application claims the priority of German number 10 2010 029 674.0 filed Jun. 2, 2010, hereby incorporated by reference.

BACKGROUND OF THE INVENTION

1. Field of Invention

The invention relates to a device for the production of tubes or sections of tubes, from which bags can be manufactured, wherein the tubes or sections of tubes have at least one layer of material, preferably a layer of paper.

2. Description of the Prior Art

The starting material for bags, particularly paper bags, is typically made available as webs wrapped around rolls. In the device named above, tubes or sections of tubes are produced from one or multiple webs by means of unrolling the web in an unwinder and subsequently providing the same with an application of glue in an edge region thereof (longitudinal gluing). A paste wheel serves this purpose. This is carried out in a device for the provision of at least one edge region with glue. The term "glue" is hereby used as an abbreviation meaning all types of adhesive. Following application of the glue, both edges of the web are turned around in the tube forming device in such a manner that the edges overlap each other and the application of glue bonds the overlapping edges. A tube machine as well as a device for providing at least one edge region with a glue, wherein a paste wheel is provided in the same, are disclosed in the publication DE 10 2007 032 401 A1.

Next, the tubes formed in this manner are typically isolated, either by means of a flush-cut knife or in a tearing station in which sections of tube are torn from the tube. In the latter case, lines of attenuation, for example perforations, have been inserted into the web already prior to the gluing process.

Next, the pieces of tube are processed into bags in a separate device.

Frequently, paper bags are not just made of one, but rather several layers. As such, bags for construction materials are made of an outer and an inner paper layer, and a (plastic) film layer lying between the paper layers. In order to increase the mechanical strength of these bags, the individual webs are arranged with a slight offset, such that each individual web can be provided with a longitudinal gluing, and subsequently each web can be bonded to itself.

Such bags are sufficiently strong. However, a problem arises when such bags are filled. Air is introduced during the filling process, and must be able to escape from the bag. This is because the bag could otherwise burst. In order to enable the escape of air, the tubes or sections of tubes are provided in the tube machine with channels through which air can move. This is done by applying perforations to the individual webs, wherein the perforations are sufficiently small for air, but not for the product, to escape. Conventional needle roller arrangements are used for this purpose, as presented in DE 195 44 330 A1, for example. The individual webs are arranged in such a manner that each of the perforations are offset to each other, in order to enable the escape of air while preventing the escape of the product filled in the bag. Such air vent perforations are not possible for single-layer tubes, because these would also allow the escape of the product.

The perforation process by means of needle rollers is complex. First, the construction costs, and therefore the sales price, of such a device are relatively high. Second, in the event that a change in the perforation scheme is desired, either the needles of the roller, or the needle roller itself, must be switched out.

SUMMARY OF THE INVENTION

The problem addressed by the present invention is that of suggesting a device and a method by which the air-permeable channels can be produced in a simpler manner.

The problem is solved by the inventive device for the production of tubes or sections of tubes, and the associated method, as well as by the characteristic features thereof.

According to the same, the device for the provision of glue on at least one edge region of each material web has glue application valves, and at least two glue application valves are functionally assigned to each material web. In this way, each of these glue valves can apply a so-called bead of glue on the edge region of a material web. The advantage of a glue valve is that the same can be switched, such that the application of glue can be interrupted. In this way, tracks of glue are created which are noncontinuous. The breaks create air-permeable channels. Such an application of glue was not possible with the paste wheels used previously.

The at least two glue valves, the same being functionally assigned to a material web, can be supplied with a glue via feed lines. However, it can be contemplated and is advantageous to supply these glue valves with two different types of glue. For example, at least one valve can carry a dispersion adhesive which dries quickly and thereby enables rapid bonding of the edges. At least one second valve can carry a starch glue, for example. The same dries relatively slowly, but at the same time offers very high strength. By combining different types of adhesive, it is possible to achieve both instant stability and high strength. This was previously not possible.

By means of the invention, needle rollers can now be left out of the process, such that a part of the acquisition and operating costs is removed. Regarding operating costs, it is a positive benefit that only the chronological control of the valves must be changed when a product is changed. It is not necessary to position a further needle roll or to change or replace a needle roll.

Air vent channels can even be produced in this manner for single-layer tubes. This was not possible with devices according to the prior art.

It is especially advantageous if at least one nozzle plate is functionally assigned to each material web, wherein at least two glue application valves are functionally assigned to said nozzle plate and to said material web. The component assembly comprising at least one nozzle plate and optionally the glue valves can be switched out in a particularly simple manner. In the present case, the glue application valves can be attached on a nozzle head, wherein the nozzle head is also the support for the nozzle plate. This possibility constitutes an interesting aspect of the invention, because a nozzle plate can have a glue outlet port extending from each valve, and the glue outlet ports can occupy positions with a fixed separation distance from each other in the dimension which is transverse to the direction of the transport of the material web. In the event that this separation distance should be altered, the nozzle plate can simply be switched out for this purpose.

A further advantageous embodiment of the invention enables a configuration wherein the at least one nozzle plate can be easily displaced relative to the machine support frame. In this way, the positions of the glue application valves can be adjusted to the width of the material web, for example. This is particularly advantageous in cases where the center axes of the material webs, independent of the width thereof, always remains in the same position.

In a further embodiment of the invention, at least two nozzle plates are provided which can be displaced with respect to each other. The direction of displacement in this case preferably runs perpendicular to the direction of the transport of the material web. Each material web is functionally assigned to a nozzle plate in this case. If the lateral separation distance of the edges of the material web changes, the nozzle plates can also be displaced relative to each other, such that the glue is always applied near the edge.

Furthermore, it is advantageous if at least two of the following positions are provided, wherein the glue valves and/or the nozzle plates can be brought into said positions, preferably in a pivotable manner:

a glue application position a cleaning and maintenance position a service position.

In the glue application position, the glue outlet ports of the nozzle plates, or the glue application valves, are oriented against the web when the same is running over a backing surface such as a roll, for example. Naturally, the openings, which are especially susceptible to fouling, are difficult to access in the glue application position. For this reason, the glue application valves are mounted in the machine support frame in a pivotable manner, for example. By pivoting the same into a cleaning and maintenance position, access to the components which carry glue is simplified. Particularly, the glue outlet ports can be oriented toward a collecting pan at this point, wherein the same can collect contaminated cleaning fluid during a cleaning process and carry off the same. Because access to the nozzle plates is nevertheless hindered in the cleaning and maintenance position as well, a service position can additionally be provided in which the nozzle plates, for example, can be switched out.

In a further advantageous embodiment of the invention, a computer-controller unit is provided which controls the opening and closing processes of the glue application valves. In this case, it is particularly advantageous that in this way the opening and closing times can also be varied within a later section of tube. As such, the interruption of the glue tracks can be stopped in the region of bases coming later. This measure can increase the strength of the bags.

In a further embodiment, the opening and closing time points for the glue application valves can be calculated by means of the computer-controller unit from an appearance of the air-permeable channels when the same can be prespecified. The appearance of these channels can be communicated to the computer-controller unit via a suitable data exchange pathway. A direct input of the same, perhaps via a touchscreen display, can also be contemplated.

Additional embodiments of the invention will become apparent upon examination of the present description and the claims.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
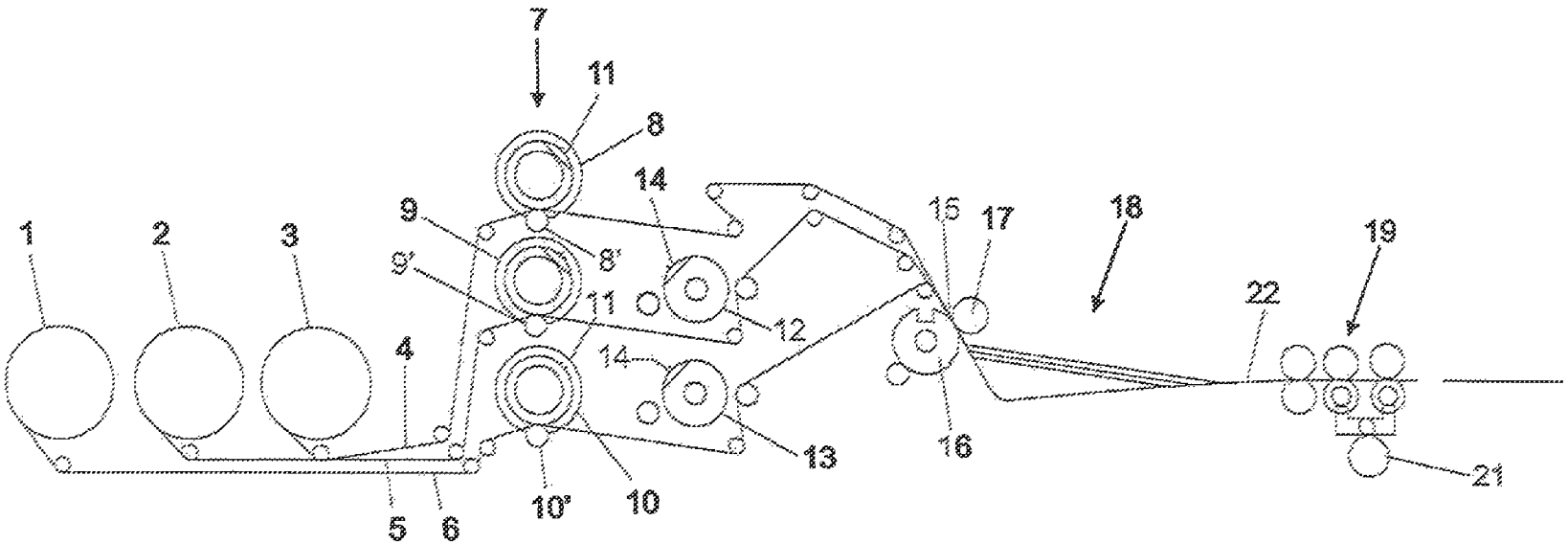
Fig. 1: PRIOR ART
FIG. 1 a schematic side view of a tube machine for the production of sections of tubes according to the prior art, FIG. 2 a device according to the invention for producing tubes or sections of tubes, FIG. 3 the plane of view III-III in FIG. 2, FIG. 4 the plane of view IV-IV in FIG. 2, FIG. 5 a further embodiment of the invention.

FIG. 1 shows a schematic side view of a so-called tube machine for the production of sections of tube, which serve as semi-finished products for the production of bags. In the illustrated embodiment, this tube machine consists of three unrolling positions in which web rolls 1, 2, 3 are held one behind the other. Said unrolling positions are not shown in detail. Flat material webs 4, 5, 6 are drawn off said web rolls via guide rollers and unwinder- and/or draw-off devices. In actual practice, the webs 4 and 6 are paper, and the web 5 is plastic, for example. Perforating cylinders 8, 9, 10 are mounted in perforating station 7 in a machine support frame, wherein the latter is not illustrated. Said perforating cylinders are preferably provided with their own drives, and the perforating blades 11 thereof work together with opposing blade cylinders 8', 9', 10'.

Cross-gluing cylinders 12, 13 are mounted in the machine support frame behind the cross-perforating cylinders 8-10 with respect to the feed direction of the webs, wherein said webs are guided with a clearance between each of the same. Said cross-gluing cylinders 12, 13 are provided with drives, and the cross-gluing strips thereof provide the paper webs 5 and 6 with applications of adhesive which run crosswise. The cross-gluing strips 14 of the cross-gluing cylinders 12, 13 obtain their application of glue from adhesive application rolls in the conventional manner. In order to bond three webs to each other, only two cross-gluing cylinders are necessary. A cross-gluing is typically undertaken so that during the production of bags the individual layers do not become misaligned when regions of the tube sections are folded.

Downstream of the cross-gluing cylinders 12, 13, the paper webs 4, 5, 6 are brought together into one multi-layer web 15 for the purpose of bonding the same. An edge region of the multi-layer web, at which position the individual webs are laterally displaced with respect to each other (i.e. the same are shifted relative to each other in the perpendicular dimension), is provided with the applications of adhesive which will later form the longitudinal seams, by means of longitudinal gluing rolls 16 designed as glue application wheels. Each layer is functionally assigned to a longitudinal gluing roll in this case. The longitudinal gluing rolls obtain their application of adhesive in the conventional manner from a glue application roll or fountain roll, which is not illustrated. In addition, a backing roll 17 is provided, wherein the multi-layer web 15 is supported on the same when being provided with the longitudinal glue application.

The multi-layer web prepared in the described manner is then folded into a tube 22 in a tube forming device 18, wherein each of the edge regions of the individual layers not participating in an overlapping are bonded to each other.

In the draw-off station 19, individual sections of tube 20 are then drawn off from the tube. The draw-off station is provided with a conventional draw-off assembly having two rolls which are driven at different peripheral speeds. The front roll of the two forms a holding roll, and the rear roll forms a draw-off roll, wherein backing rolls mounted in a movable support are pressed onto the holding roll and the draw-off roll with a frequency defining the draw-off interval of the individual sections 20, wherein the draw-off is carried out by a roll 21 provided with pins.

Figure 2:
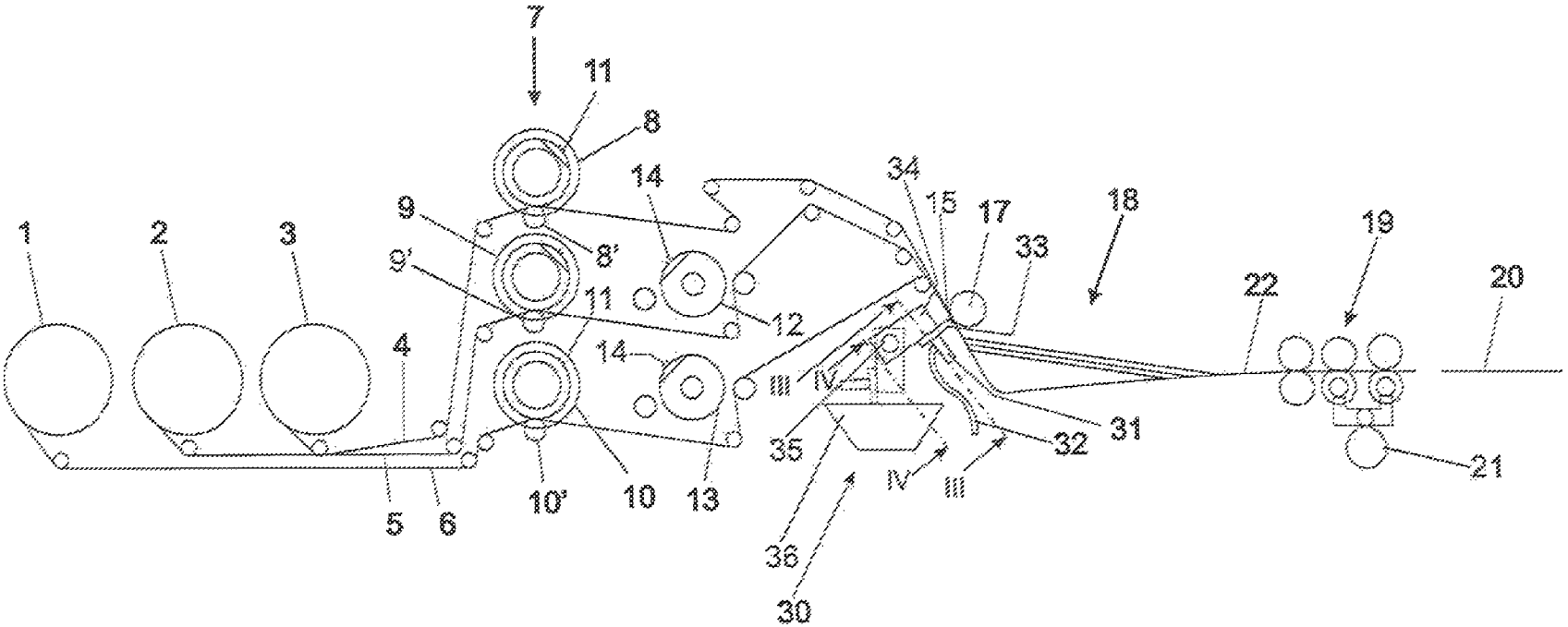

FIG. 2 shows a device according to the invention for the purpose of producing tubes or sections of tubes. Compared to the device according to FIG. 1, the longitudinal gluing wheels 16 are replaced in this case by a device for providing the edge region of each material web with glue. This glue application device 30 has multiple glue application valves 31 which can release the flow of glue onto the material webs or interrupt said flow of glue. This is described in greater detail with reference to the following figures. The glue application valves obtain the glue via various feed lines which are provided with glue from a glue reservoir via a pump. Of these, the glue line 32 is shown. Additional feed lines are provided which are not shown individually. The glue application valves 31 are distributed on one or multiple nozzle plates 33, and glue channels which are not visible in the illustration are incorporated into the same and end in glue outlet ports. The nozzle plate 33 is arranged on a support body 34 which is connected to the machine support frame in a suitable manner. The machine support frame is not shown. For example, the support body 34 can be arranged on a rod 35 in a pivotable manner. The pivot position of the same is illustrated by a dashed line. In this pivoted position, the so-called cleaning position, the glue application valves 31, the glue channels, and additional glue feed components can be cleaned out with a suitable cleaning agent, which is typically water. The cleaning agent can be collected by means of the tray 36 and carried away. A configuration wherein the support body can further be pivoted into a service position (not illustrated) can be contemplated, such that components of the glue application device 30 can be better accessed. It can perhaps be desirable to switch out the nozzle plates 33 for other nozzle plates with a different separation distance between glue outlet ports in the dimension which is perpendicular to the direction of transport of the material web.

Figure 3:
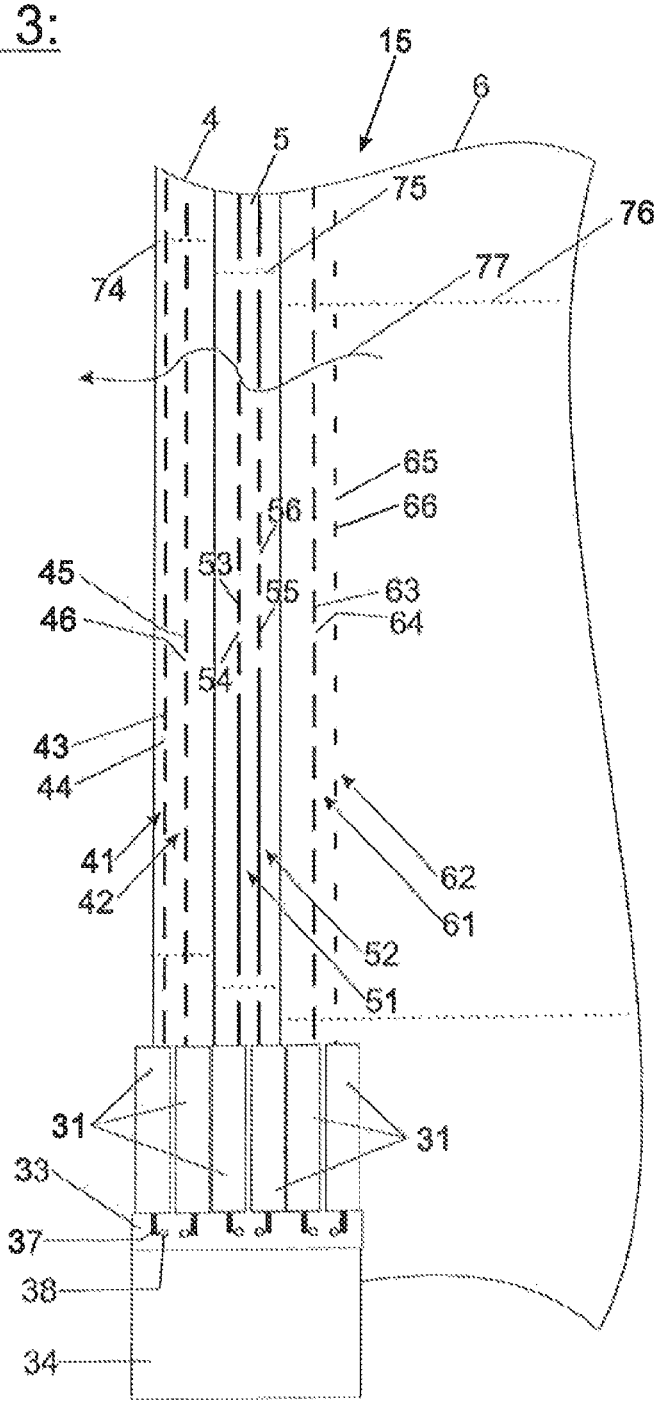

FIG. 3 shows the viewing plane III-III from FIG. 2. First is the multi-layer material web 15 which consists of the individual material webs 4, 5 and 6. The individual webs are offset with respect to each other in the direction x, which is perpendicular to the direction of transport. This means that the webs are each shifted in the direction x with respect to each other, such that the edges of the webs which are otherwise covered are exposed. This enables the provision of a longitudinal glue application to the exposed edges. Each material web is also provided with cross-perforations 74, 75, 76 which each run in the direction x, and along which the tube is divided into tube pieces. In the embodiment shown, the perforations of the individual material layers are shifted in the direction R with respect to each other. As an alternative, perforations or flush cuts which lie above each other and which can be produced after the formation of the tube are commonly used.

Two glue valves 31 are functionally assigned to each material web, and glue tracks of varying specification can be formed by means of said glue valves 31. For this purpose, a glue channel 37 supplies each glue valve, and each glue channel ends in one or multiple glue outlet ports 38.

At this point, various glue track patterns are shown. The material layer 4 has two glue tracks 41 and 42, which each have glue track sections 43, 45 and breaks 44 and 46. The glue tracks 41 and 42 can be separated from each other by a fixed distance, for example 10, 15, or 20 mm. The glue track sections 43 and 45 each have the same length and are interrupted by breaks 44 and 46 which are shorter in comparison. The glue track sections 45 and the breaks 46 are displaced in the direction R, such that each glue track section 43 completely covers a break 46 and also overlaps the glue track section 45 neighboring the break 46. In this way, a so-called labyrinth ventilation can be created in a simple manner, wherein the air found in the fill material, or found in the bag at the point when the bag is later filled, can escape through the same, and wherein none or a small amount of the fill material can escape through the same.

The glue tracks 61, 62 are identical to the glue tracks 41 and 42. In this case, the length of the glue track section 63 corresponds to the length of the breaks 66, and likewise the length of the break 64 corresponds to the length of the glue track section 65.

The glue tracks 51 and 52 are clearly different from the glue track pairs 41, 42, and 61, 62 described above. The glue track sections 53 and 55 each have a variable length, rather than a constantly consistent length. In contrast, the breaks 54 and 56 are always illustrated with the same length, but can of course also vary in their length. From the perspective of the glue application valves, the first glue track sections 53 and 55 have a comparatively large length. This area can later form the lower area of a bag. This configuration provides the strength for this section which is necessary for the filling process. Air can escape through the breaks 54 and 56 which are arranged farther above. However, the glue track is interrupted in the region of the perforation 75, so that following the draw-off of tube sections, no glue can exit the ends thereof and potentially foul parts of the machine.

Line 77 shows a possible flow of air through the glue tracks. The glue tracks shown are entirely possible embodiments. The number of possible embodiments is of course infinitely large; however, all such possibilities fall within the concept of the present invention. The number of individual material webs is also variable, even though only three are included in all figures. The number of glue tracks can also be larger, although the same are always given in pairs for each location in FIG. 3. As such, a correspondingly large number of glue application valves can be included, and/or multiple glue outlet ports can be functionally assigned to each glue application valve.

The types of glue which make up the glue tracks can also be varied. As such, a first glue track for a material layer and/or a material web can consist of a fast-bonding adhesive, such as a dispersion adhesive, whereas a second glue track can consist of a very strong adhesive which is, however, slow to bond, such as starch glue. Of course, the glue tracks consisting of different types of adhesive can likewise form air vent channels.

Different types of adhesive could also be applied to various different types of material. Starch glue can be applied to layers of paper, for example, and hot glue can be applied to plastic coatings. The arrangement of a single layer of material itself could play a role in the selection of the type of adhesive. An outer layer of material could be provided with fast-bonding adhesive, whereas a very strong adhesive could be applied to inner layers of material. In all of these cases, optionally different types of adhesive would need to be applied to the individual glue application valves. This certainly means a somewhat higher complexity for installation, but does not pose a technical problem.

Figure 4:
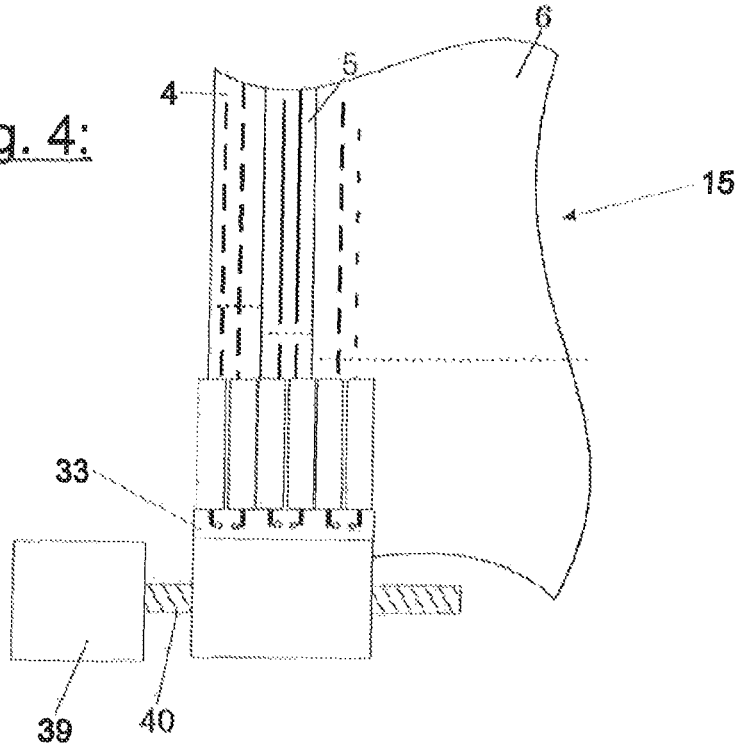

FIG. 4 shows a further aspect of the present inventions. A nozzle plate 33 is provided, and all the glue application valves 31 are arranged thereon in a fixed manner. The nozzle plate 33 itself is connected to the support body 34 in a fixed manner.

Said support body 34 can have a sliding carriage, for example, which runs on a rail which is oriented in the direction x. Said sliding carriage is not illustrated. An electric motor 39 is provided for the purpose of laterally displacing the sliding carriage and is supported on the machine support frame and drives a shaft 40 rotationally. The shaft 40 is threaded into a tapped hole of the support body, such that the rotary movement thereof results in a lateral movement of the support body and thereby also of the glue application valves. In this way, the nozzle plates 33 and glue application valves 31 can be adjusted to the position of the edges of material webs.

Figure 5:
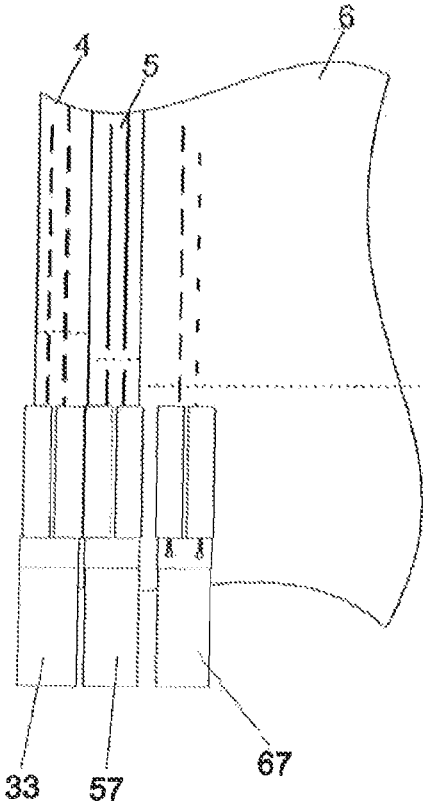

FIG. 5 shows an additional embodiment of the invention. In this case, a nozzle plate 33, 57, 67 is functionally assigned to each individual material web. In this example, each nozzle plate carries two glue application valves 31. The nozzle plates can each move relative to each other such that the positions of the nozzle plates can be adjusted to a potentially altered offset of the webs 4, 5 and 6.

All figures show different embodiments of the invention. The embodiments described in these figures and also the embodiment described in the present application can be combined with each other in any manner, and as such lead to additional advantageous embodiments of the invention.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of reference numbers | |
|---|---|
| 1 | Paper roll |
| 2 | Paper roll |
| 3 | Paper roll |
| 4 | Paper web |
| 5 | Paper web |
| 6 | Paper web |
| 7 | Perforating station |
| 8 | Perforating cylinder |
| 9 | Perforating cylinder |
| 10 | Perforating cylinder |
| 8' | Opposing blade cylinder |
| 9' | Opposing blade cylinder |
| 10' | Opposing blade cylinder |
| 11 | Perforating blade |
| 12 | Cross-gluing cylinder |
| 13 | Cross-gluing cylinder |
| 14 | Cross-gluing strip |
| 15 | Multi-layer web |
| 16 | Glue application wheel |
| 17 | Counterpressure cylinder |
| 18 | Tube forming device |
| 19 | Draw-off station |
| 20 | Individual tube section |
| 21 | Roll provided with pins |
| 22 | Tube |
| 23 | |
| 24 | |
| 25 | |
| 26 | |
| 27 | |
| 28 | |
| 29 | |
| 30 | Glue application device |
| 31 | Glue application valve |
| 32 | Glue tube |
| 33 | Nozzle plate |
| 34 | Support body |
| 35 | Rod |
| 36 | Tray |
| 37 | Glue channel |
| 38 | Glue outlet port |

-continued

| List of reference numbers | |
|---|---|
| 39 | Electric motor |
| 40 | Shaft |
| 41 | Glue track |
| 42 | Glue track |
| 43 | Glue track section |
| 44 | Break |
| 45 | Glue track section |
| 46 | Break |
| 47 | |
| 48 | |
| 49 | |
| 50 | |
| 51 | Glue track |
| 52 | Glue track |
| 53 | Glue track section |
| 54 | Break |
| 55 | Glue track section |
| 56 | Break |
| 57 | Nozzle plate |
| 58 | |
| 59 | |
| 60 | |
| 61 | Glue track |
| 62 | Glue track |
| 63 | Glue track section |
| 64 | Break |
| 65 | Glue track section |
| 66 | |
| 67 | Nozzle plate |
| 68 | |
| 69 | |
| 70 | |
| 71 | |
| 72 | |
| 73 | |
| 74 | Cross-perforation |
| 75 | Cross-perforation |
| 76 | Cross-perforation |
| 77 | Line |
| R | Direction of transport |

What is claimed is:

1. A device for the production of tubes or sections of tubes having at least one layer of material, from which bags are manufactured, comprises:

an unwinder device for unrolling at least one material web from a material web roll;

a device for providing at least one edge region of the at least one material web with a glue; and a tube forming device via which the edge region provided with glue is inverted onto, and attached to, a second edge region, such that the tubes or sections of tubes are provided with air-permeable channels therein, the device for providing the at least one edge area of each material web with the glue having at least a first glue application valve and a second glue application valve associated therewith, with the first and second glue application valves providing corresponding first and second glue tracks that each include a plurality of glue track sections and a plurality of glue track breaks, with the glue track breaks providing the air-permeable channels, with a glue track section of the first glue track (i) covering a glue track break of the second glue track and (ii) overlapping an adjoining glue track section of the second glue track.

2. The device according to claim 1, further comprising at least one nozzle plate, and wherein the at least two glue application valves functionally assigned to each material web are functionally assigned to the at least one nozzle plate.

3. The device according to claim 2, wherein the at least one nozzle plate can be displaced relative to a machine support frame of the device.

4. The device according to claim 2, wherein at least two of the nozzle plates are provided which can be displaced relative to each other.

5. The device according to claim 1, wherein the glue valves and/or the nozzle plate can pivot between at least two positions selected from a glue application position, a cleaning and maintenance position, and a service position.

6. The device according to claim 1, further comprising a computer-controller device that controls opening and closing processes of the glue application valves.

7. The device according to claim 6, wherein opening and closing time points for the glue application valves can be calculated by the computer-controller device from an appearance of the air-permeable channels with said appearance being prespecified.

8. The device according to claim 1, wherein the bags are paper bags.

9. The device according to claim 1, wherein the at least one layer of material is at least one layer of paper.

10. The device according to claim 1, wherein a glue track section of the second glue track (iii) covers a glue track break of the first glue track and (iv) overlaps an adjoining glue track section of the first glue track.

11. A method for the production of tubes or sections of tubes having at least one layer of material, from which bags are manufactured, said method comprising the following steps:

unrolling at least one material web from a material web roll in an unrolling direction;

providing at least one edge region of the at least one unrolled material web with a glue; and inverting and attaching the edge region provided with glue onto a second edge region in a tube forming device, with the tubes or sections of tube being provided with air-permeable channels therein, the step of providing the at least one edge region of each material web with the glue including, with at least a first glue application valve and a second glue application valve, providing corresponding first and second glue tracks that each include a plurality of glue track sections and a plurality of glue track breaks, with the glue track breaks providing the air-permeable channels, and with a glue track section of the first glue track (i) covering a glue track break of the second glue track and (ii) overlapping an adjoining glue track section of the second glue track.

12. The method according to claim 11, wherein the bags are paper bags.

13. The method according to claim 11, wherein the at least one layer of material is at least one layer of paper.

14. The method according to claim 11, wherein the step of providing the at least one edge region of each material web with the glue includes providing a glue track section of the second glue track that (iii) covers a glue track break of the first glue track and (iv) overlaps an adjoining glue track section of the first glue track.

* * * * *